United States Patent [19]

Winand

[11] 4,326,942

[45] Apr. 27, 1982

[54] DEVICE FOR ELECTROLYZING METALS

[75] Inventor: René Winand, Rixensart, Belgium

[73] Assignee: "Metallurgie Hoboken - Overpelt", Brussels, Belgium

[21] Appl. No.: 165,094

[22] Filed: Jul. 1, 1980

[30] Foreign Application Priority Data

Jul. 2, 1979 [LU] Luxembourg ..... 81446

[51] Int. Cl.[3] ..... C25C 7/00; C25C 7/02

[52] U.S. Cl. ..... 204/275; 204/268

[58] Field of Search ..... 204/268, 275, 276

[56] References Cited

U.S. PATENT DOCUMENTS 3,558,466 1/1971 Lebrizzi et al. ..... 204/269
3,915,817 10/1975 Bennett ..... 204/269
3,966,567 6/1976 Pace et al. ..... 204/269
4,053,377 10/1977 Schlain et al. ..... 204/275
4,102,754 7/1978 Hedges et al. ..... 204/269

*Primary Examiner*—R. L. Andrews
*Attorney, Agent, or Firm*—Scully, Scott, Murphy & Presser

[57] ABSTRACT

There is described a method for electrolyzing and particularly electrorefining metals such as copper, by circulating the electrolyte through channels formed between substantially parallel electrodes arranged some distance away from one another, in which a substantially uniform electrolyte flow rate is retained at least at the inlet to the channels between the electrodes, independently from the cathode thickness increase and the anode thickness decrease during the electrorefining.

A device for working this method is also described.

10 Claims, 3 Drawing Figures

DEVICE FOR ELECTROLYZING METALS

This invention relates to a method for electrolyzing, more particularly for electrorefining metals such as copper, preferably under high current density, which comprises circulating the electrolyte through channels formed between substantially parallel electrodes which are arranged some distance away from one another.

Many methods are known to electrorefine a metal under high current density.

However such known methods have various drawbacks, particularly when it is intended to perform a refining electrolysis under very high current density, of a metal such as copper. Indeed it is noticed either that it is impossible to obtain and retain during said refining electrolysis under very high current density, an uniform mass transfer to the cathode, which results in the forming of an unsatisfying coating, or the known means to obtain an uniform mass transfer are not usable in industrial practice due to economical or technological reasons.

A main object of the invention is to provide a method allowing to obviate the above drawbacks, that is a method which makes possible an uniform mass transfer to the cathode while being economically and technically warranted.

For this purpose according to the invention, a substantially uniform electrolyte flow rate is retained at least at the inlet to the channels between the electrodes, independently from the cathode thickness increase and the anode thickness decrease during the electrorefining.

Advantageously the electrolyte flow is divided before entering said channels between the electrodes, into adjoining discrete streams which are substantially similar to those streams formed inside said channels and said streams and channels are so directed relative to one another so that each such stream can pass through the channel substantially without disturbance.

The invention further pertains to a device for electrorefining metals, notably for the working of the above-defined method.

Said device comprises on the one hand, an electrolysis cell inside which can be mounted at least two electrode plates in substantially parallel relationship in spaced relation to each other and on the other hand, means for insuring a substantially uniform electrolyte flow through channels formed between two succeeding electrodes, some such electrodes being connected to an anodic current supply, and other electrodes to a cathodic current supply, in such a way that two successive electrodes comprise an anode-cathode unit.

Said device is characterized in that guide means are provided to divide the electrolyte flow upstream of the channels formed between the electrodes into adjoining discrete streams which are substantially similar to those streams formed inside the channels, in such a way that each such channel comprises constantly during the electrorefining, the substantially continuous extension of a channel formed by said guide means.

In a particular embodiment, said guide means comprise baffle-plates mounted upstream of the inlet to said channels formed between the electrodes, said electrodes and said baffle-plates being movable relative to one another according to the cathode thickness increase and the anode thickness decrease during the electrorefining, in such a way that said baffle-plates form constantly together with said electrodes, substantially continuous passageways for the electrolyte.

Other details and features of the invention will stand out from the description given below by way of non limitative examples and with reference to the accompanying drawings, in which.

In the various figures, the same reference numerals pertain to similar elements.

Figure 1:
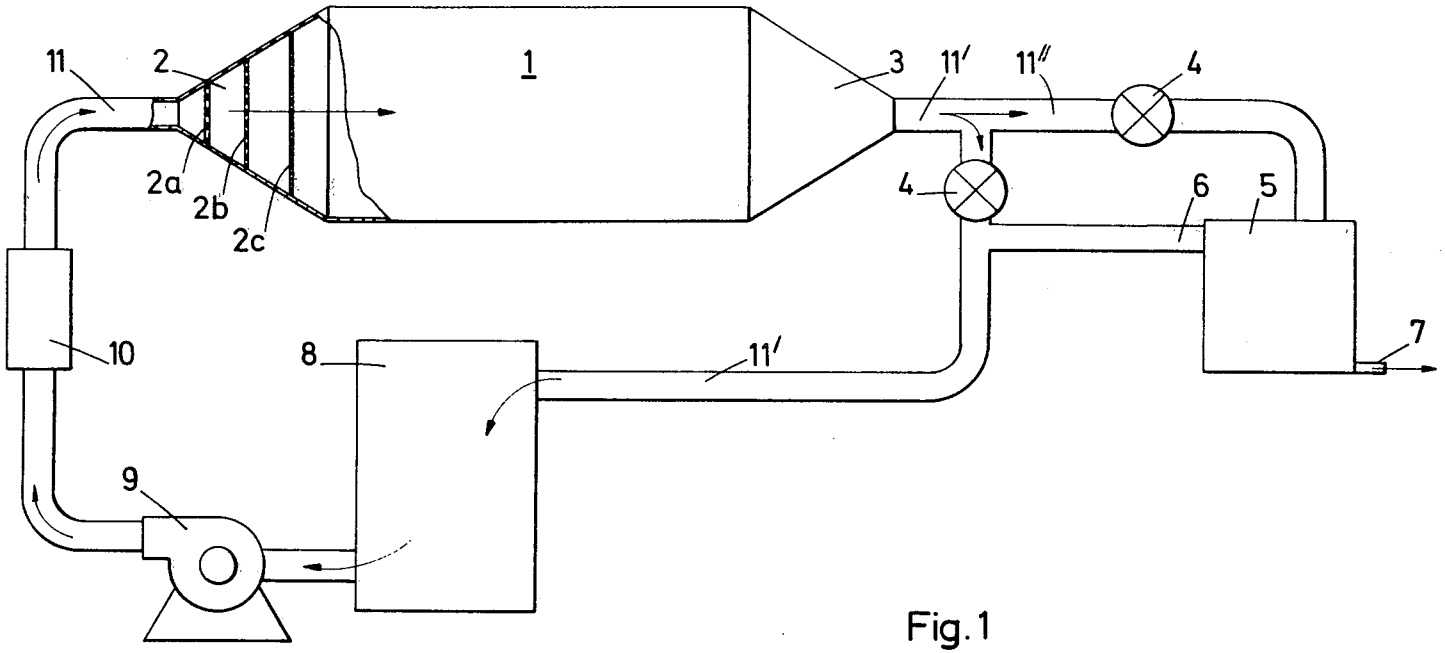
FIG. 1 shows diagrammatically the hydraulic circuit of the complete electrorefining device.

The invention relates to a method for electrolycally refining preferably under high current density, a metal such as copper.

The electrolyte is caused to flow through electrode plates arranged substantially in parallel relationship some distance away from one another, preferably at high speed under turbulent flow conditions, to insure as large a mass transfer as possible to the electrodes.

As already mentioned above, it is however noticed that if special dispositions are not taken, the cathode thicknesses increase and the anode thicknesses decrease on the side edges of the electrode plates, in the location where the electrolyte enters between said plates, out of proportion to the thickness of the other locations on said electrodes plates. Such irregularities in the mass transfer to the cathode does not allow for an efficient control of the electrolysis, in such a way that the refined metal deposit on the cathode has an irregular structure and a unsatisfying quality.

The method according to the invention lies essentially in obviating said drawback by retaining a substantially uniform flow rate of the electrolyte at least upstream of the inlet to the channels between the electrodes, independently of the cathode thickness increase and the anode thickness decrease. In this way there is noted that it is possible to retain substantially in every location of the electrodes, substantially the same mass transfer conditions. The spacing between two successive electrodes remains in such a case, substantially constant in every location of said electrodes.

A specific feature of the invention lies in guiding the electrolyte flow before entering the channels formed between said electrodes, in such a way as to prevent disturbances in the flow at said inlet.

The electrolyte flow is preferably divided before entering between said electrodes, into adjoining discrete streams which are substantially similar to those streams formed inside the channels and said streams and channels are so directed or aligned relative to one another as to let each such stream pass substantially without disturbance between the electrodes.

It has indeed been shown by experience that it is essential to obtain a regular electrolyte flow to obtain a homogenous electrolytic deposit, without uncontrolled overthickness on the cathode edges and with a quality which satisfies the present industrial requirements.

To obtain a high enough throughput, to the cathode is applied a current density of at least 10 $A/dm^2$ and preferably at least 20 $A/dm^2$.

On the other hand, the electrolyte is caused to flow inside the flow channels between the electrode plates with a speed of at least 1 m/sec. and preferably at least 4 m/sec.

In a particular embodiment of the method according to the invention, the electrolyte flow speed inside the channels between the electrodes is so adjusted as to cause part at least of the insoluble particles possibly formed during the electrorefining, to be carried out of said channels, part at least of said particles carried away being retained before recycling the electrolyte between said electrodes.

Presently the insoluble particles originating from the anodes settle at the bottom of the electrolysis cells and are removed periodically therefrom.

A few actual examples of the working of the method according to the invention for electrorefining copper are grouped hereinafter.

The spacing between the anode plate and the cathode plate was 6 mm. The electrolyte had a speed of 4 m/sec., the temperature thereof was about 50° C., the $Cu^{++}$ concentration was 50 g/liter and the concentration of the sulfuric acid used was 100 g/liter; said electrolyte did not contain any inhibitor.

The thickness of the copper coating obtained was 2 mm.

With the parameters as defined above, the density of the cathode current was varied from 20 to 100 A/dm$^2$.

The results which were obtained are given in the following table:

| Current density (A/dm$^2$) | Voltage across the terminals (V) | Specific energy consumption (kWh/Cu kg) | Appearance of the deposit |
|---|---|---|---|
| 20 | .32 | .275 | smooth |
| 50 | .80 | .688 | smooth |
| 70 | 1.12 | .963 | very slightly rough |
| 100 | 1.60 | 1.375 | slightly rough |

The invention also pertains to an electrorefining device for the working of the above-described method.

FIG. 1 is a general diagrammatic view from the hydraulic circuit of a particular embodiment of the electrorefining device according to the invention. Said circuit comprises an electrolysis cell 1 provided with an inlet distributor 2 and an outlet manifold 3.

Said distributor 2 and manifold 3 comprise the connection respectively between the feed pipe 11 for the electrolyte and the discharge pipe 11', both pipes having a generally circular cross-section, with cell 1 which has a rectangular cross-section.

The passage of the electrolyte between pipes 11 and 11' through cell 1 should occur without hydraulic flow disturbance.

To insure a substantially uniform flow from pipe 11 to cell 1 through distributor 2, substantially over the complete rectangular cross-section thereof, said distributor 2 comprises distributing means formed for example by a sequence of three grates 2*a*, 2*b*, and 2*c*. The desired electrolyte speed through the cell is insured by a pump 9. The electrolyte flow rate is measured by a flow-meter 10 cut-in into pipe 11 between said pump and distributor 2.

The electrolyte flowing out of cell 1 passes through manifold 3 into discharge pipe 11'. Said pipe 11' is provided with a branching to let the electrolyte possibly loaded with insoluble particles originating from the anodes, pass completely or partly through pipe 11'' to an equipment for recovering the insoluble particles 5 before feeding the electrolyte through outlet 6 back to the discharge pipe 11'. Valves 4 are provided in pipes 11' and 11'' to allow adjusting the ratio between those electrolyte volumes which are deflected to the recovery equipment 5. The one valve may even in some cases be completely closed in such a way that either all of the electrolyte is recycled without passing through the recovery equipment, or all of the electrolyte is fed to said latter equipment.

Said recovery equipment 5 may be formed either by hydrocyclones the underflow of which is filtered by a filter-press, or by a series of filter-presses, or else by any other combination of decanting-filtering which is suitable for the kind of insoluble particles to be separated.

Said retained insoluble particles generally form a concentrated slurry or a cake which is discharged through outlet 7.

The discharge pipe 11 opens into a storage tank 8 which possibly allows adjusting the electrolyte temperature.

The electrolyte is then sucked from said storage tank by means of pump 9 to be fed back to cell 1.

Figure 2:
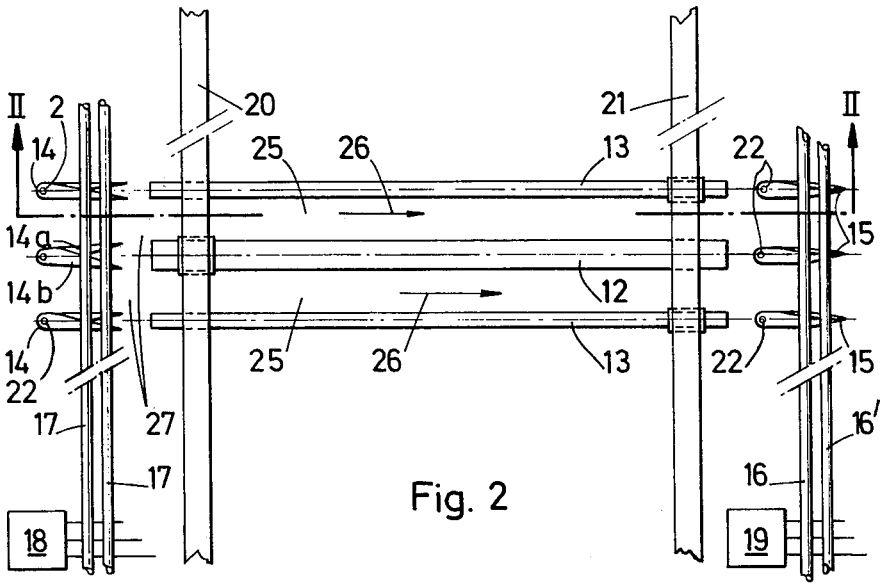
FIG. 2 is a diagrammatic plan view of part of the electrorefining device in a particular embodiment.
Figure 3:
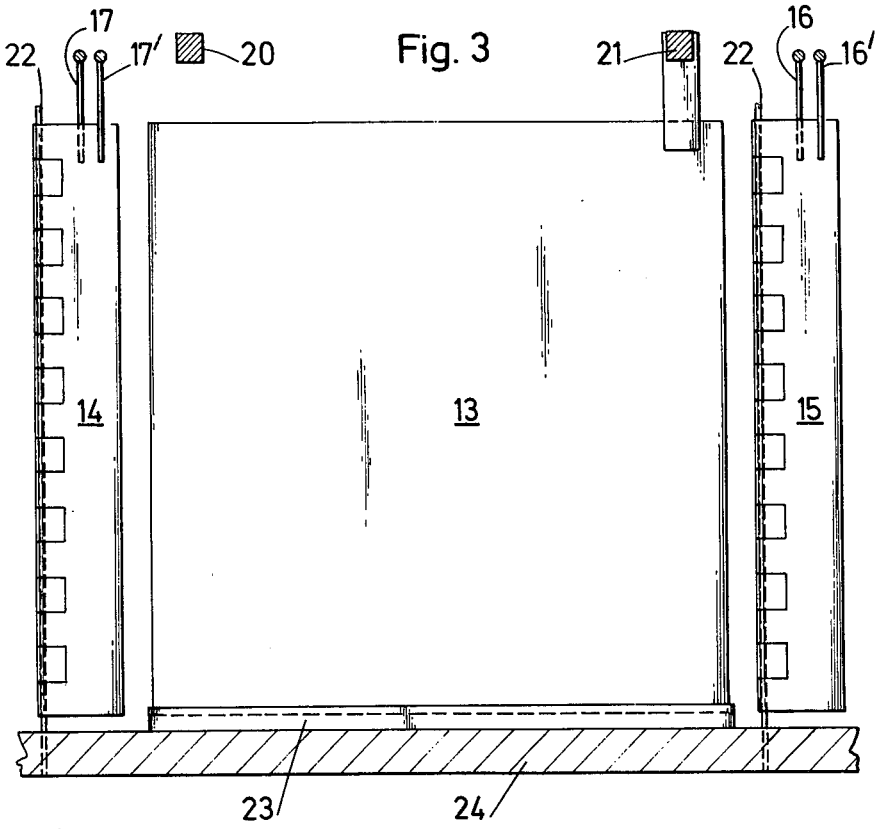
FIG. 3 is a section view along line III—III in FIG. 2.

FIGS. 2 and 3 show part of an electrorefining cell 1 according to the invention.

Said cell may comprise an unlimited number of anode plates 12 and cathode plates 13.

The anode plates 12 are connected to anode current bus-bars 20, while the cathode plates 13 are connected to cathode current bus-bars 21.

Said anode and cathode plates 12 and 13 are mounted in parallel relationship some distance away from one another to form between said succeeding electrodes, that is an anode and a cathode adjacent to one another, channels 25 through which the electrolyte can flow in the direction as shown by arrows 26. Said pump 9 thus comprises means to insure a substantially uniform flow of the electrolyte between said electrodes.

Said cell has for an inventive feature guide means, notably baffle-plates 14 which allow to divide the electrolyte flow upstream of channels 25, into continuous streams 27 which are substantially similar to those streams formed inside channels 25.

Moreover said guide means are so arranged as to direct said streams 27 in such a way that each channel 25 comprises the substantially continuous extension of a similar channel bounded by said baffle-plates 14 and directing a stream 27.

Said baffle-plates 14 and electrode plates 12 and 13 are movable relative to one another according to the thickness increase of said cathode plates 13 and the thickness decrease of the anode plates 12 during the electrorefining in such a way that said baffle-plates form constantly together with the electrodes, substantially continuous passageways for the electrolyte between the distributor 2 and the channels 25.

Consequently the retaining of the alignment between flow channels 25 and the feed pipe 11 is obtained either by moving the baffle-plate 14, or by moving the electrodes together with the holders thereof not shown, or by moving the electrorefining cell proper relative to the baffle-plates.

In the embodiment as shown in FIGS. 2 and 3, said baffle-plates 14 can be directed according to the progress of the electrorefining.

Each one of said baffle-plates is formed by two flaps 14*a* and 14*b* swinging about a rod 22 the axis of which lies in substantial parallel relationship with plates 12 and 13 and at right angle to the flow direction 26 of the electrolyte.

Advantageously guide means formed for example also by baffle-plates 15 comprised of two flaps 15*a* and 15*b* hinged on a rod 22 may also be provided downstream of the anode and cathode plates 12 and 13 as shown in FIGS. 2 and 3.

Motors 18 and 19 are provided to position the baffle-plate flaps by acting on links 17, 17' and 16, 16'. The control of said motors may be separate or interlocked, for instance by retro-action of the position of the outlet baffle-plates 15 on the position of the inlet baffle-plates 14.

To retain as accurate as possible the spacing between electrodes 12 and 13, said electrodes may be guided in a rail 23 fastened to the bottom 24 of the electrorefining cell as shown n FIG. 3.

Moreover the electrorefining cell may either have side walls raised relative to electrodes 12 and 13 by a height which prevents the electrolyte overflowing, or be provided with a sealed cover not shown in the figures.

In some cases the electrodes may also be bipolar electrodes.

It must be understood that the invention is in no way limited to the above embodiments and that many changes may be considered without departing from the scope of the invention as defined by the following claims.

For instance the guide means provided downstream of the plates 12 and 13, that is at the outlet from channels 25 might possibly be dispensed with. If however such guide means are provided, they could be comprised of fixed baffle-plates. Said baffle-plates 14 and 15 may moreover have very varying shapes and designs. They might be adjusted in various ways. It is actually sufficient that said baffle-plates prevent the electrode side edges disturbing the hydraulic flow. Said baffle-plates may be made from any materal, notably an electrically-insulating material.

It would also be possible to provide a plurality of cells 1 in series or parallel connection, while the number of anodes 12 and cathodes 13 per cell might also vary.

Finally the electrorefining method and device might be used with other metals than copper.

It is further to be noted that the baffle-plates are preferably located some distance away from the electrodes to avoid forming baffles for the side edges thereof during the electrorefining.

When the baffle-plates are comprised of two flaps to allow forming upstream of the channels 25 adjacent streams which are substantially similar to those streams inside channels 25, the edges of the one flap lying on the same side as the electrodes relative to rod 22, are preferably retained substantially in the plane of the one large surface from an electrode plate or slightly outside said plane, on the outer side thereof, the corresponding edge of the other flap lying substantially in the plane of the other large surface from the same electrode plate or slightly outside said plane, on the outer side thereof.

I claim:

1. An apparatus for electrolyzing and electrorefining metals under high current density, said device comprising an electrolysis cell inside of which is mounted at least one pair of electrode plates in substantially parallel spaced relationship forming a channel therebetween, one of said plates being connected to an anodic current supply said electrodes thereby forming an anode-cathode unit; said cell further having an inlet and an outlet pipe with an electrolytic flow therein; said cell further comprising guide means provided within the electrolytic flow upstream to the electrodes, said guide means and electrodes being movable relative to one another in such a manner as to maintain the guide means as an extension of the surface of said electrodes, so as to generally extend the channel formed therebetween.

2. A device as defined in claim 1, wherein the guide means are movable in relationship to said electrodes, said electrodes being stationary in relationship to said electrolysis cell.

3. An apparatus for electrolyzing and electrorefining metals under high current density, said device comprising an electrolysis cell inside of which is mounted at least one pair of electrode plates in substantially parallel spaced relationship forming a channel therebetween, one of said plates being connected to an anodic current supply said electrodes thereby forming an anode-cathode unit; said cell further comprising guide means provided within the electrolytic flow upstream to the electrodes, said guide means being positioned so as to extend the surface of said electrodes, so as to generally extend the channel formed therebetween, said guide means comprising baffle-plates mounted upstream of the inlet to said channels formed between the electrodes, said electrodes and said baffle-plates being movable relative to one another according to the cathode thickness increase and the anode thickness decrease during the electrorefining, in such a way that said baffle-plates are an extension of said electrodes, forming substantially continuous passageways for the electrolyte.

4. Device as defined in claim 3, in which said baffle-plates are made from an electrically-insulating material.

5. Device as defined in claim 4, in which said baffle-plates lie some distance away from the electrodes.

6. Device as defined in claim 5, in which said baffle-plates can be adjusted to produce undisturbed turbulent flow of the electrolyte during the electrorefining process.

7. Device as defined in claim 6, in which each one of said baffle-plates is formed by two flaps swinging about a common axis substantially in parallel relationship with the electrode plates and substantially at right angle to the electrolyte flow direction.

8. Device as defined in claim 7, in which a mechanism is provided to retain the edge of the one flap lying on the same side as the electrodes relative to the swinging axis thereof, substantially in the plane of the one large surface from an electrode plate or slightly outside said plane on the outer side of said plate, the corresponding edge of the other flap lying substantially in the plane of the other large surface from the same electrode or slightly outside said plane on the outer side of said plate.

9. Device as defined in claim 1, in which said guide means have such a profile as to create undisturbed turbulent flow of the electrolyte flow at the inlet to the channels between the electrodes.

10. Device as defined in claim 3, in which said baffle-plates cooperate with control and driving means to move said baffle-plates according to the cathode thickness increase and the thickness decrease of the corresponding anode.

* * * * *